US005295329A

United States Patent [19]

Rothlisberger

[11] Patent Number: 5,295,329

[45] Date of Patent: Mar. 22, 1994

[54] CERAMIC, AIR-COOLED SMOOTHING BAR

[75] Inventor: John A. Rothlisberger, Portland, Oreg.

[73] Assignee: General Electric Company, Schenectady, N.Y.

[21] Appl. No.: 979,920

[22] Filed: Nov. 23, 1992

[51] Int. Cl.[5] ..... B24B 21/08; B24B 21/10

[52] U.S. Cl. ..... 51/141; 51/148; 51/266

[58] Field of Search ..... 51/135 R, 139, 141, 51/266, 148, 135 BT, 356, 138

[56] References Cited

U.S. PATENT DOCUMENTS

| | | | |
|---|---|---|---|
| 552,066 | 12/1895 | Leach | 51/141 |
| 2,162,279 | 6/1939 | Herchenrider | 51/141 |
| 2,477,602 | 8/1949 | Herchenrider | 51/141 |
| 2,527,554 | 10/1950 | Kimball | 51/141 |
| 3,049,839 | 8/1962 | Smith | 51/141 |
| 4,656,790 | 1/1987 | Mukai | 51/141 |
| 4,662,121 | 5/1987 | Ginter | 51/141 |
| 5,101,600 | 4/1992 | Morris | 51/141 |

OTHER PUBLICATIONS

"GE Industry Sales & Services", sketch entitled Aluminum Smoothing Bar Holder, Jul. 16, 1991.

*Primary Examiner*—Bruce M. Kisliuk
*Assistant Examiner*—Bo Bounkong
*Attorney, Agent, or Firm*—Nixon & Vanderhye

[57] ABSTRACT

In a sanding apparatus (10) including a drive roll (14), at least two feed rolls (16, 18), a guide roll (20) and an endless belt (12) arranged to engage each of the feed rolls to thereby define a closed loop; and an elongated smoothing bar (30) located between the two feed rolls with a back side of the belt passing over the smoothing bar, an improvement wherein the smoothing bar is constructed of an elongated metal bar having a mounting face (36), a belt face (34) and a pair of side faces (38, 40). At least one cooling passage (42) is formed in the bar and extends longitudinally from one end of the bar to the other. A plurality of air shower holes (46) are arranged to discharge cooling air onto the back side of the endless belt (12).

16 Claims, 2 Drawing Sheets

CERAMIC, AIR-COOLED SMOOTHING BAR

TECHNICAL FIELD

This invention relates to high speed production sanding machines of the type generally used to profile plywood, hard board or MD particle board sheets and more specifically, to a new smoothing bar located between the belt sander rolls which supports and contours the belt's profile from the back side as the belt engages the boards.

BACKGROUND AND SUMMARY OF THE INVENTION

Conventional smoothing bars include a steel channel holder fitted with a wooden strip insert, to which a felt or high density foam pad layer is stapled or glued. A graphite coated paper is then wrapped around the assembly and stapled to the wooden strip. This conventional construction is intended to allow the sanding belt to slip across the smoothing bar with less friction and heat build-up. There are, however, several problems associated with this conventional construction. For example, the smoothing bars wear out very quickly, up to four times per eight hour shift (as many as 12 shutdowns per day). In addition, the soft construction does not give adequate profile control of the boards since the boards being sanded may well be harder than the smoothing bar. As a result, the boards will deflect the smoothing bar and the sanding belt, resulting in sanded boards being thinner on the edges than in their centers, and with variable "waviness" in the finished surfaces.

Ultrasmooth finishes and precise dimensions are particularly important to laminators and furniture manufacturers, as well as to the manufacturers of high quality plywood, MD fiber board and hard board. As a result, a new smoothing bar construction is desirable which overcomes the problems associated with the conventional bars as described above.

The object of this invention, therefore, is to provide a new smoothing bar construction which enables precise dimensional specifications to be achieved with consistency, and which is substantially more reliable and durable so that considerable cost improvements can also be achieved by eliminating the necessity for spare smoothing bars and associated down time required to change the bars.

In accordance with a preferred embodiment of the invention, the smoothing bar includes an elongated aluminum bar machined to height, width and face profile dimensions. The bar includes a belt face, a mounting face and a pair of angled side faces. The belt face is clad with zirconia ceramic tiles which are epoxied to the bar with heat curable epoxy. The resulting substantially continuous ceramic surface is ground smooth and flat, parallel with the mounting face of the aluminum bar. The mounting face, opposite the belt face, is fitted with a hexagon steel key to locate and hold the smoothing bar in the sander's adjustable smoothing bar platen. The hexagon key permits the smoothing bar to be installed without modification to a commercially available Kimwood sander as a direct replacement for the conventional smoothing bar.

The aluminum bar is drilled through, with two parallel holes extending through the entire length of the bar. These holes, which provide cooling passages, are tapped at either end for receiving hose end connectors so that air under pressure can be supplied to both ends of the bar. The two cooling passages are intersected at spaced locations along the length of the bar with air shower holes drilled perpendicular to the cooling passages (when viewed from above), but also at an angle to the belt face plane of the bar. The air shower holes open along the angled side faces of the bar so that the cooling air is discharged directly towards the back face of the belt, so as to clean the latter upstream and downstream of the bar.

The following advantages accrue as a result of the presently disclosed ceramic air-cooled smoothing bar:

(a) smoothing bar life is estimated to be 8 to 12 months versus 2 to 4 hours as in the conventional construction with savings in both manpower and machine down time;

(b) the regrindable ceramic tile finish allows for renewal at least once before recladding is required;

(c) the cooling air/shower stabilizes the bar profile and cleans dirt/dust from the sanding belt's surface, thereby preventing build-up or impingement between the bar and the belts;

(d) the zirconia ceramic tiles are abrasion-resistant, thermally stable, and do not build up with belt resin or dirt;

(e) the one-piece aluminum clad construction is solid and allows for even profile sanding of any width board, without variances in caliber between edges and centers of boards, even after continuous days of running; and (f) no increase in horsepower is required due to the ceramic "hard" bar. In some applications, due to the rigidity of the ceramic bar, it is in fact possible to use less sanding pressure to achieve the finish and profile required and therefore reduce the actual power usage.

Thus, in its broadest aspects, the invention relates to a smoothing bar for use in a sanding apparatus comprising an elongated metal bar formed to include a belt face, a mounting face and a pair of opposite side faces, at least one cooling passage extending lengthwise of the bar from one end of the bar to the other; and a plurality of air holes arranged along the length of the cooling passage, substantially perpendicular to said cooling passage.

In another aspect, the invention relates to a smoothing bar for use in a sanding apparatus comprising an elongated metal bar formed to include a belt face, a mounting face and a pair of opposite side faces, a plurality of ceramic tiles adhered directly to the belt face; at least one cooling passage extending lengthwise of the bar from one end of the bar to the other; and a plurality of air holes arranged along the length of the cooling passage.

In accordance with still another aspect of the invention, there is provided in a sanding apparatus including a drive roll, at least two feed rolls, a guide roll, and an endless belt arranged to engage each of the rolls to thereby define a closed loop; and a smoothing bar located between the two feed rolls with a back side of the belt passing over the smoothing bar, the improvement comprising the smoothing bar constructed of an elongated metal bar having a mounting face, a belt face and a pair of side faces; at least one cooling passage formed in the bar and extending longitudinally from one end of the bar to the other, and a plurality of air shower holes arranged to discharge cooling air onto the back side of the endless belt.

Additional objects and advantages of the invention will become apparent from the detailed description which follows.

BEST MODE FOR CARRYING OUT THE INVENTION

Figure 1:
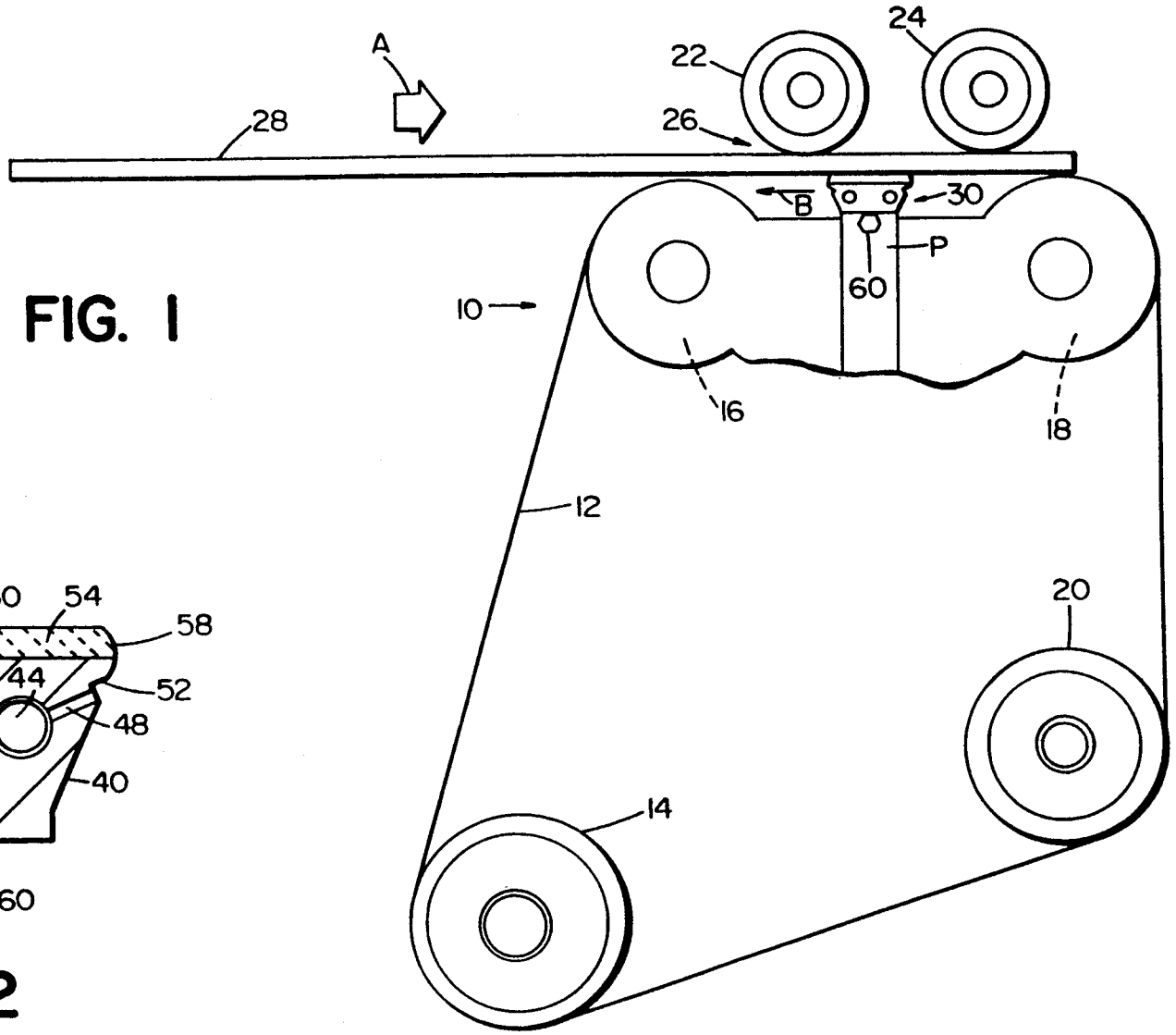
FIG. 1 is a diagrammatic side view of a conventional sanding machine incorporating a smoothing bar in accordance with an exemplary embodiment of this invention.

With reference now to FIG. 1, a conventional Kimwood sanding machine 10 includes an endless sanding belt 12 driven by a drive roll 14. The belt is arranged to travel about a closed loop defined by the drive roll 14, a pair of feed rolls 16 and 18, and a guide roll 20, all of which are located within the interior of the loop circumscribed by the belt 12. A pair of hold-down rolls 22, 24 are located in juxtaposition to the feed rolls 16, 18 and vertically spaced therefrom to define a roll nip 26 through which a board 28 travels during a sanding operation.

A smoothing bar 30 in accordance with this invention is shown supporting the back side of the belt 12 between the feed rolls 16 and 18, thus serving to support and contour the profile of the belt from the back side of the latter as the board 28 posses between the hold-down rolls 22, 24 and the belt 12. As the board travels through the sanding machine in a direction indicated by arrow A, the belt 12 travels in an opposite direction indicated by arrow B, thereby creating the necessary friction to effect smoothing of the board.

Figure 2:
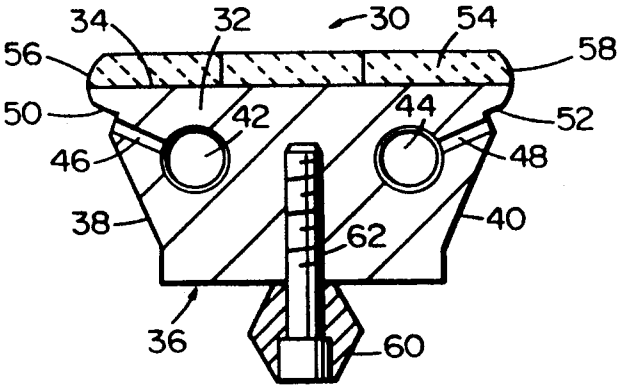
FIG. 2 is a side section of the smoothing bar in accordance with a preferred embodiment of the invention.

With reference now to FIG. 2, the preferred smoothing bar 30 in accordance with this invention includes a T-6061 aluminum bar 32 machined to the desired height, width and face profile dimensions. As shown in FIG. 2, the bar 32 is formed with a belt face 34, a mounting face 36 and a pair of angled side faces 38 and 40.

The aluminum bar 32, which in the exemplary embodiment has a length of 65 inches, is drilled through from one end to the other with a pair of parallel holes 42, 44 which form cooling passageways for the bar, as described in greater detail below. The holes 42 and 44, which have a preferred diameter of about ½ inch, are tapped at each end with an internal thread for connection to air hoses connected to a supply of air under pressure. The internal cooling passageways 42, 44 are each intersected by a plurality of air shower holes, two shown at 46, 48, extending at a 22.5° angle relative to the mounting face 36 (and perpendicular to the passageways 42, 44 when viewed in plan) on ½ inch center to center spacing along either side face 38, 40 of the bar 32. The air shower holes 46, 48 serve to exhaust the cooling air from cut-outs 50, 52 extending lengthwise along the side faces 38, 40. As best seen in FIG. 2, but with reference also to FIG. 1, the air shower holes 46, 48 are oriented to direct the cooling air directly on the back side of the belt 12.

Figure 3:
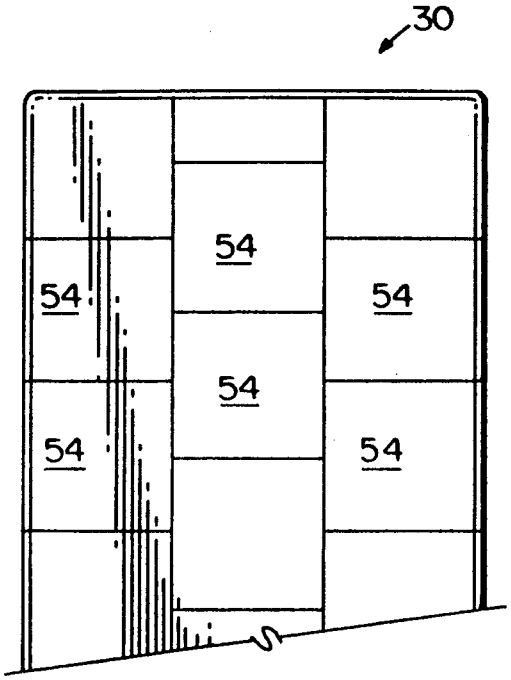
FIG. 3 is an enlarged partial plan view of the bar illustrated in FIG. 2.

The belt face 34 of the bar 32 is clad with 1 inch square × ¼ inch thick zirconia ceramic tiles 54 which are epoxied to the bar with conventional heat cure epoxy. In a preferred arrangement, the tiles are arranged in staggered rows as illustrated in FIG. 3 along the entire length of the bar. In this arrangement, the width dimension of the belt face 34 is precisely 3 inches so that three 1 inch tiles may be arranged along the width of the bar.

The ceramic surface formed by the zirconia ceramic tiles is ground smooth (10 micro-inches) and flat, i.e., parallel to the belt face 34 and mounting face 36 and radiused along the forward and rearward edges 56, 58 as best seen in FIG. 2.

Figure 4:
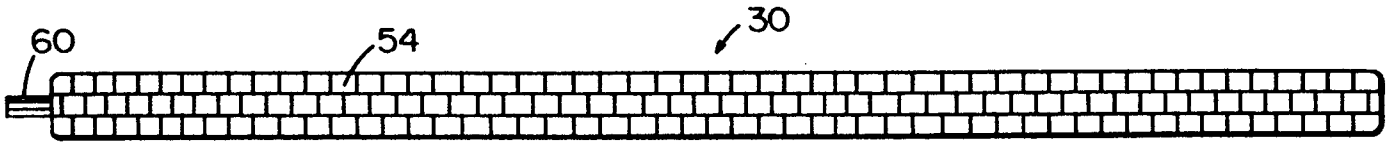
FIG. 4 is a top plan view of the bar illustrated in FIG. 1.

The mounting face 36 of the bar 32 mounts an elongated hexagonal steel key 60 by which the smoothing bar is secured to the smoothing bar platen P of the sander. As illustrated in FIG. 4, the key lies flush with one end of the smoothing bar but extends about 2½ inches beyond the other end of the smoothing bar to facilitate insertion and removal of the bar from the sander. The key 60 may be secured to the mounting face by a plurality of screw fasteners 62 (one shown in FIG. 2), or other suitable means.

In the particular embodiment disclosed, i.e., in association with a conventional Kimwood sander, the ceramic smoothing bar may be installed without modification to the sander as a direct replacement for the felt-/paper composite smoothing bars described above. It should be noted, however, that a simple redesign of the key 60 is all that is required to enable use of the smoothing bar with most commercially available sanders of this type.

In use, a 50 to 90 p.s.i. plant air supply is adequate to cool the bar and to provide belt cleaning shower air. It is preferred that the air be supplied to both ends of the bar to insure uniform cooling. The cooling air tends to stabilize the bar profile and, in combination with the individual arrangement of the ceramic tiles, permits more uniform expansion/contraction and therefore less distortion in the bar assembly. With reference again to FIGS. 1 and 2, it will be apparent that the cooling air discharging through the air shower holes 46, 48 will impinge directly on the sanding belt 12 just prior to and just after engagement with the sanding bar to thereby clean dirt/dust from the belt, and to prevent build-up between the smoothing bar and the belt.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A smoothing bar for use in a sanding apparatus comprising:

an elongated metal bar formed to include a belt face, a mounting face and a pair of opposite side faces; a pair of cooling passages formed in said bar and extending lengthwise from one end of the bar to the other in substantially parallel relationship; and a plurality of air holes extending from each cooling passage and opening on an adjacent one of said opposite side faces.

2. A smoothing bar for use in a sanding apparatus comprising:

an elongated metal bar formed to include a belt face, a mounting face and a pair of opposite side faces, a plurality of ceramic tiles adhered directly to said belt face; a pair of cooling passages extending lengthwise of said bar from one end of the bar to the other; and a plurality of air holes arranged along the length of each cooling passage, and opening on an adjacent one of said opposite side faces.

3. The smoothing bar of claim 2 wherein said tiles are adhered by means of a heat curable epoxy.

4. The smoothing bar of claim 3 wherein said tiles are arranged adjacent one another in a plurality of substantially parallel rows extending along a length dimension of the bar to thereby provide a substantially continuous ceramic surface over said belt face.

5. The smoothing bar of claim 4 wherein said tiles in one row are offset from tiles in an adjacent row.

6. The smoothing bar of claim 2 wherein said mounting face is provided with an elongated, profiled key adapted to secure the smoothing bar to an adjustable smoothing bar platen of the sanding apparatus.

7. The smoothing bar of claim 2 wherein said ceramic tiles are 1 inch squares with a thickness of about ¼ inch.

8. The smoothing bar of claim 2 wherein said air holes are oriented at an angle of about 22.5° relative to said mounting face.

9. In a sanding apparatus including a drive roll, at least two feed rolls, a guide roll and an endless belt arranged to engage each of said rolls to thereby define a closed loop; and an elongated smoothing bar located between said two feed rolls with a back side of said belt passing over said smoothing bar, the improvement comprising said smoothing bar constructed of an elongated metal bar having a mounting face, a belt face and a pair of opposite side faces; a pair of cooling passages formed in said bar and extending longitudinally from one end of the bar to the other, and a plurality of air shower holes communicating with each of said cooling passages and opening on an adjacent one of said opposite side faces to thereby discharge cooling air onto the back side of said endless belt on either side of said smoothing bar.

10. The sanding apparatus of claim 9 wherein said belt face is covered with ceramic material provided as a plurality of tiles adhered directly to said belt face.

11. The sanding apparatus of claim 10 wherein said tiles are adhered by means of a heat curable epoxy.

12. The sanding apparatus of claim 11 wherein said tiles are arranged adjacent one another in a plurality of substantially parallel rows extending along a length dimension of the bar to thereby provide a substantially continuous ceramic surface over said belt face.

13. The sanding apparatus of claim 12 wherein said tiles in one row are offset from tiles in an adjacent row.

14. The sanding apparatus of claim 12 wherein said ceramic tiles are 1 inch squares with a thickness of about ¼ inch.

15. The sanding apparatus of claim 14 wherein said bar has a width of about 3 inches, and wherein three parallel rows of tiles extend along said bar.

16. The sanding apparatus of claim 9 wherein said mounting face is provided with an elongated, profiled key to locate and hold the smoothing bar to an adjustable smoothing bar platen of the sanding apparatus.

* * * * *